US006681775B2

(12) United States Patent
Wang

(10) Patent No.: US 6,681,775 B2
(45) Date of Patent: Jan. 27, 2004

(54) BRUSH PROVIDED WITH RETRACTABLE BRISTLES TO FACILITATE REMOVAL OF TANGLED HAIR STRANDS THEREFROM

(75) Inventor: Huo-Pia Wang, No. 9-2, Alley An-Tou, Yen-Ping Li, Chang-Hua City (TW)

(73) Assignee: Huo-Pia Wang, Chang-Hua (TW)

( * ) Notice: Subject to any disclaimer, the term of this patent is extended or adjusted under 35 U.S.C. 154(b) by 35 days.

(21) Appl. No.: 10/099,225

(22) Filed: Mar. 14, 2002

(65) Prior Publication Data

US 2003/0172947 A1 Sep. 18, 2003

(51) Int. Cl.[7] ..... A45D 24/42

(52) U.S. Cl. ..... 132/119; 15/169; 15/184; 15/186

(58) Field of Search ..... 132/119, 121, 132/123, 154; 15/169, 184, 186; 119/628, 629

(56) References Cited

U.S. PATENT DOCUMENTS 2,708,765 A * 5/1955 Vann ..... 15/246
3,110,053 A * 11/1963 Surabian ..... 15/159.1
3,172,139 A * 3/1965 Wire ..... 15/160
3,368,554 A * 2/1968 Chou ..... 601/137
4,028,768 A * 6/1977 Pascal ..... 15/203
4,225,997 A * 10/1980 Thomas et al. ..... 15/184
4,412,365 A * 11/1983 Schmitt ..... 15/184
4,860,692 A * 8/1989 Beard ..... 119/629
5,862,563 A * 1/1999 Hartmann ..... 15/169
6,427,633 B1 * 8/2002 Ogden ..... 119/628

* cited by examiner

*Primary Examiner*—Kevin Shaver
*Assistant Examiner*—Stephanie Willatt
(74) *Attorney, Agent, or Firm*—Merchant & Gould, P.C.

(57) ABSTRACT

A brush includes a brush body that defines a bristle-receiving chamber therein, and that has a combing wall formed with a plurality of bristle-extension apertures in spatial communication with the bristle-receiving chamber. A bristle-holding element is disposed movably in the bristle-receiving chamber. A plurality of bristles are mounted on the bristle-holding element, and extend through the bristle-extension apertures in the combing wall, respectively. An urging member is disposed in the bristle-receiving chamber for urging the bristle-holding element toward the combing wall of the brush body. An operating member is connected to the bristle-holding element to move the bristle-holding element against urging action of the urging member away from the combing wall of the brush body.

4 Claims, 7 Drawing Sheets

BRUSH PROVIDED WITH RETRACTABLE BRISTLES TO FACILITATE REMOVAL OF TANGLED HAIR STRANDS THEREFROM

BACKGROUND OF THE INVENTION

1. Field of the Invention

This invention relates to a brush, more particularly to a brush provided with retractable bristles to facilitate removal of tangled hair strands therefrom.

2. Description of the Related Art

Referring to FIG. 1, a conventional brush 10 is shown to include a brush body 11 having a combing wall 13, a handgrip 12 extending from the brush body 11, and a plurality of bristles 14 mounted on the combing wall 13 of the brush body 11.

The conventional brush 10 is disadvantageous in that it is difficult and tiresome to remove hair strands (A) that entangled in the bristles 14 on the combing wall 13 of the brush body 11.

SUMMARY OF THE INVENTION

The main object of this invention is to provide a brush having retractable bristles to facilitate removal of tangled hair strands from the brush.

Accordingly, a brush of the present invention includes a brush body, a bristle-holding element, a plurality of bristles, an urging member, and an operating member. The brush body defines a bristle-receiving chamber therein, and has a combing wall formed with a plurality of bristle-extension apertures in spatial communication with the bristle-receiving chamber. The bristle-holding element is disposed movably in the bristle-receiving chamber, and is operable to move toward and away from the combing wall of the brush body. The bristles are mounted on the bristle-holding element, and extend through the bristle-extension apertures in the combing wall, respectively. The urging member is disposed in the bristle-receiving chamber for urging the bristle-holding element toward the combing wall of the brush body. The operating member is connected to the bristle-holding element for moving the bristle-holding element against urging action of the urging member away from the combing wall of the brush body.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
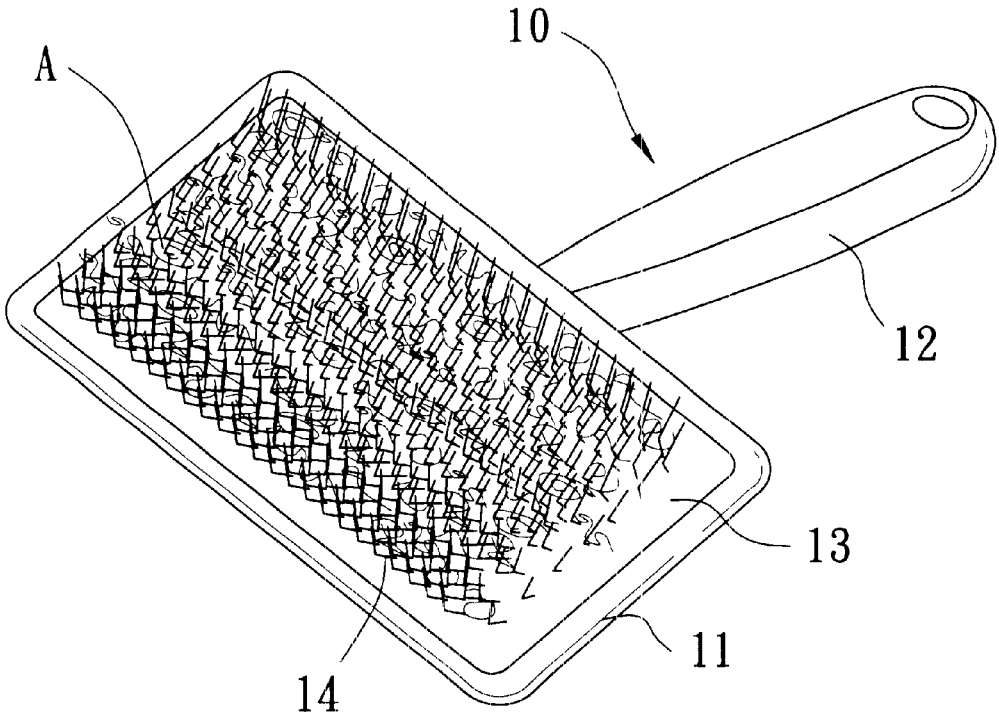
FIG. 1 PRIOR ART
FIG. 1 is a perspective view of a conventional brush.

Before the present invention is described in greater detail with reference to the following preferred embodiments, it should be noted that same reference numerals have been used to denote similar elements throughout the specification.

Figure 2:
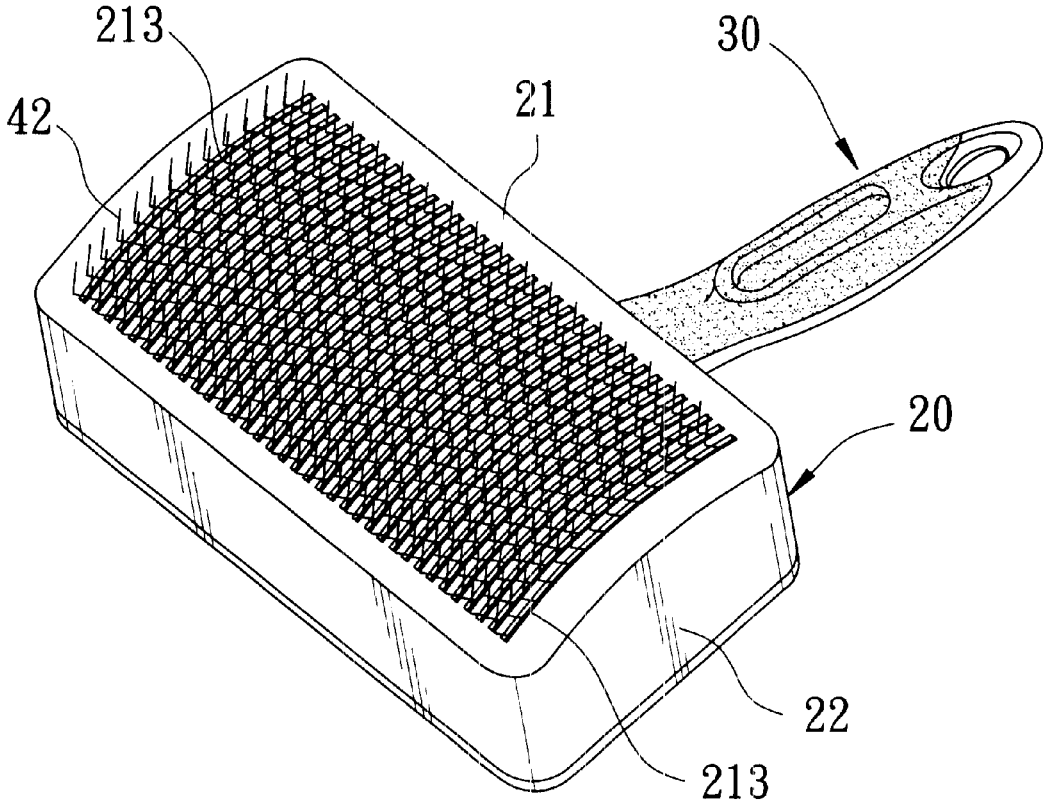
FIG. 2 is a perspective view of a preferred embodiment of a brush of the present invention.
Figure 3:
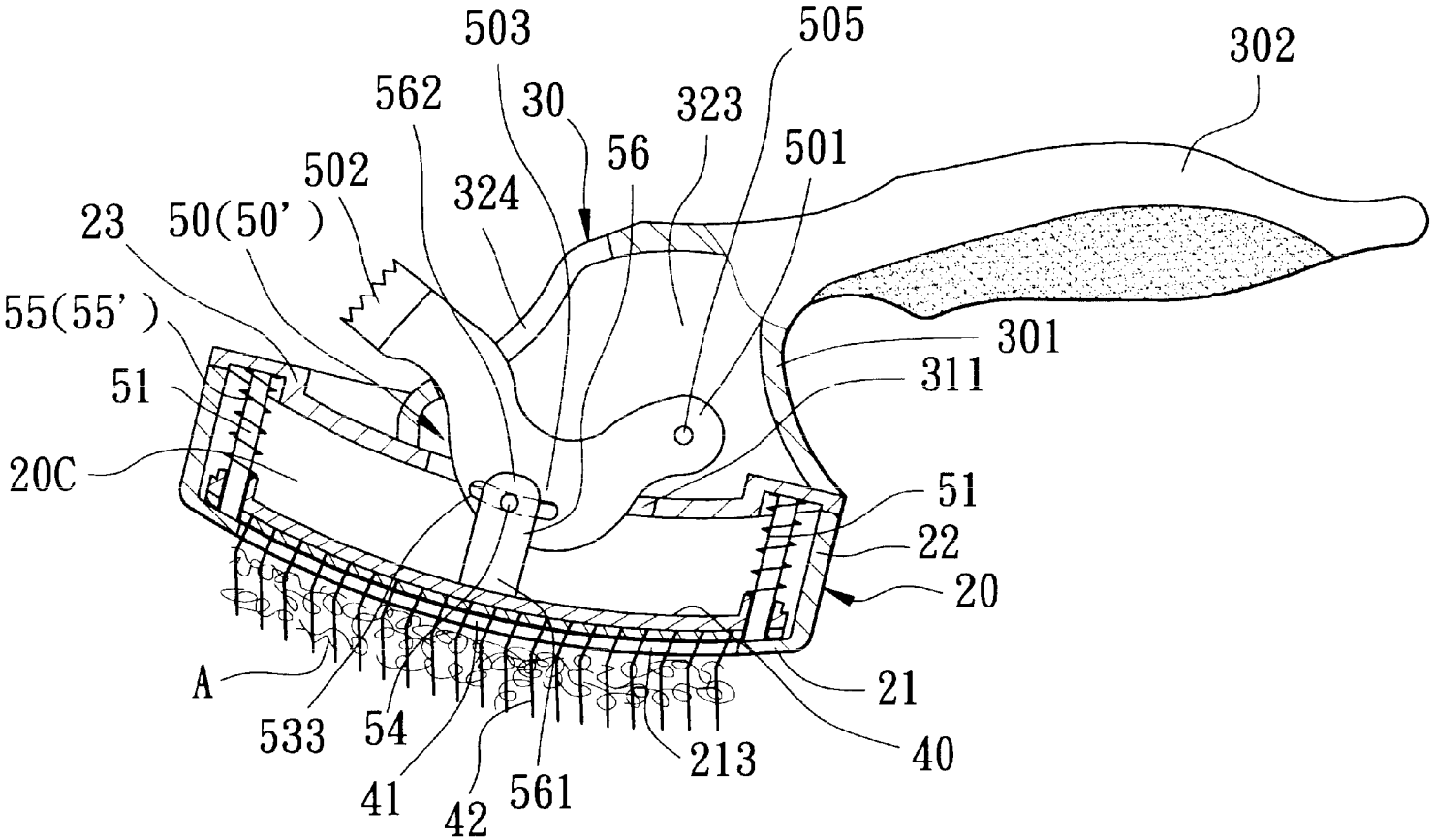
FIG. 3 is a fragmentary sectional view of the preferred embodiment, illustrating a state where hair strands entangled in the bristles.
Figure 4:
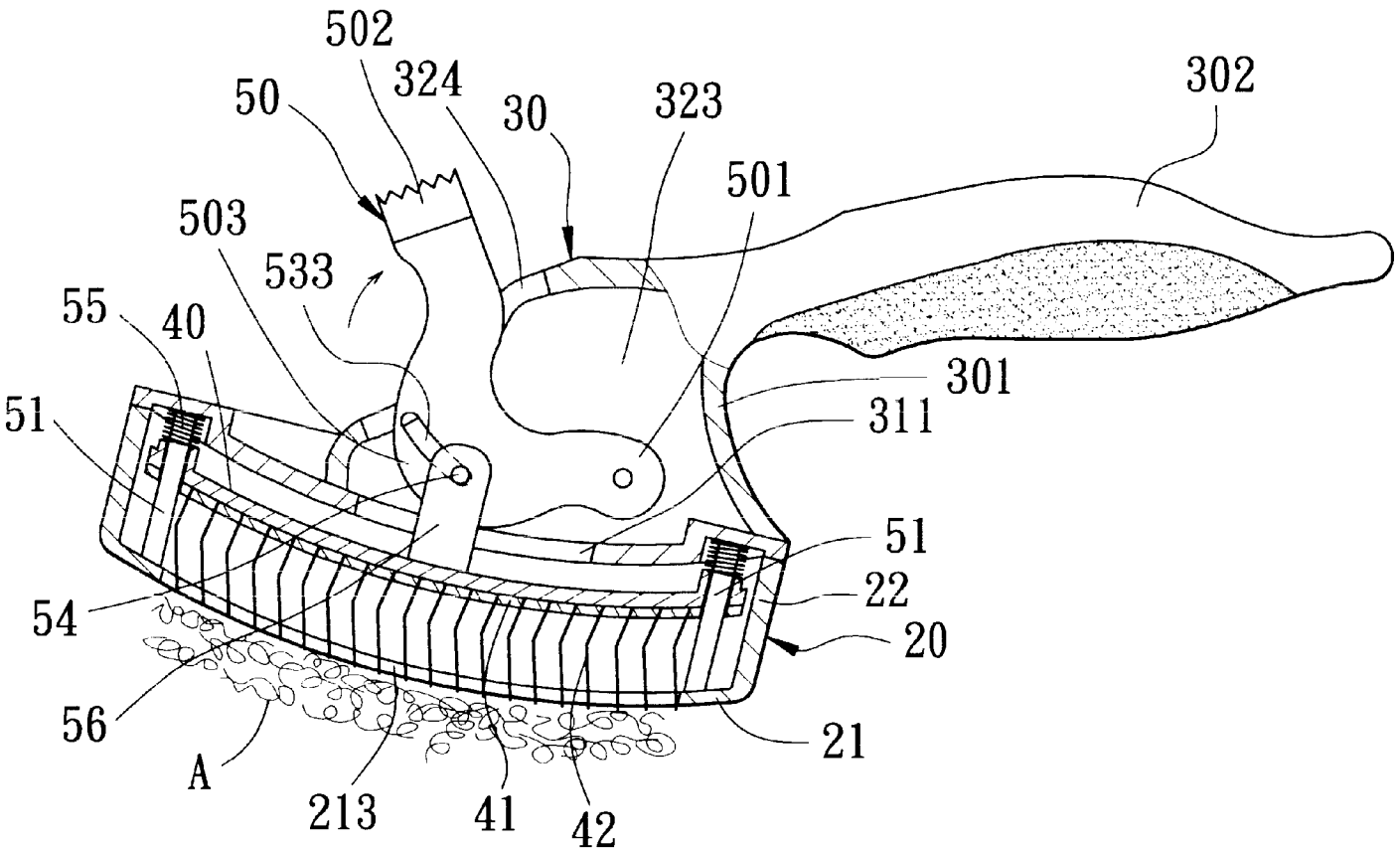
FIG. 4 is a fragmentary sectional view of the preferred embodiment, illustrating how the bristles are retracted into a bristle-receiving chamber by turning of an operating member in order to remove the tangled hair strands therefrom.

Referring to FIGS. 2 to 4, the preferred embodiment of a brush according to the present invention is shown to include a brush body 20, a handgrip 30, a bristle-holding element 40, a plurality of bristles 42, an urging member 55', and an operating member 50'.

As illustrated, the brush body 20 has a combing wall 21, a grip-mounting wall 23 opposite to the combing wall 21, and a peripheral wall 22 that interconnects the combing wall 21 and the grip-mounting wall 23 to define a bristle-receiving chamber 20C thereamong. The combing wall 21 is formed with a plurality of bristle-extension apertures 213 in spatial communication with the bristle-receiving chamber 20C.

The bristle-holding element 40, preferably in the form of a hard plate, is disposed movably in the bristle-receiving chamber 20C. The bristle-holding element 40 is operable to move toward and away from the combing wall 21 of the brush body 20.

The bristles 42 are mounted on the bristle-holding element 40 via a plastic pad 41, and extend through the bristle-extension apertures 213 in the combing wall 21, respectively.

The urging member 55' is disposed in the bristle-receiving chamber 20C for urging the bristle-holding element 40 toward the combing wall 21 of the brush body 20.

The operating member 50' is mounted on the brush body 20, and is connected to the bristle-holding element 40 for moving the bristle-holding element 40 against urging action of the urging member 55' away from the combing wall 21 of the brush body 20.

Figure 5:
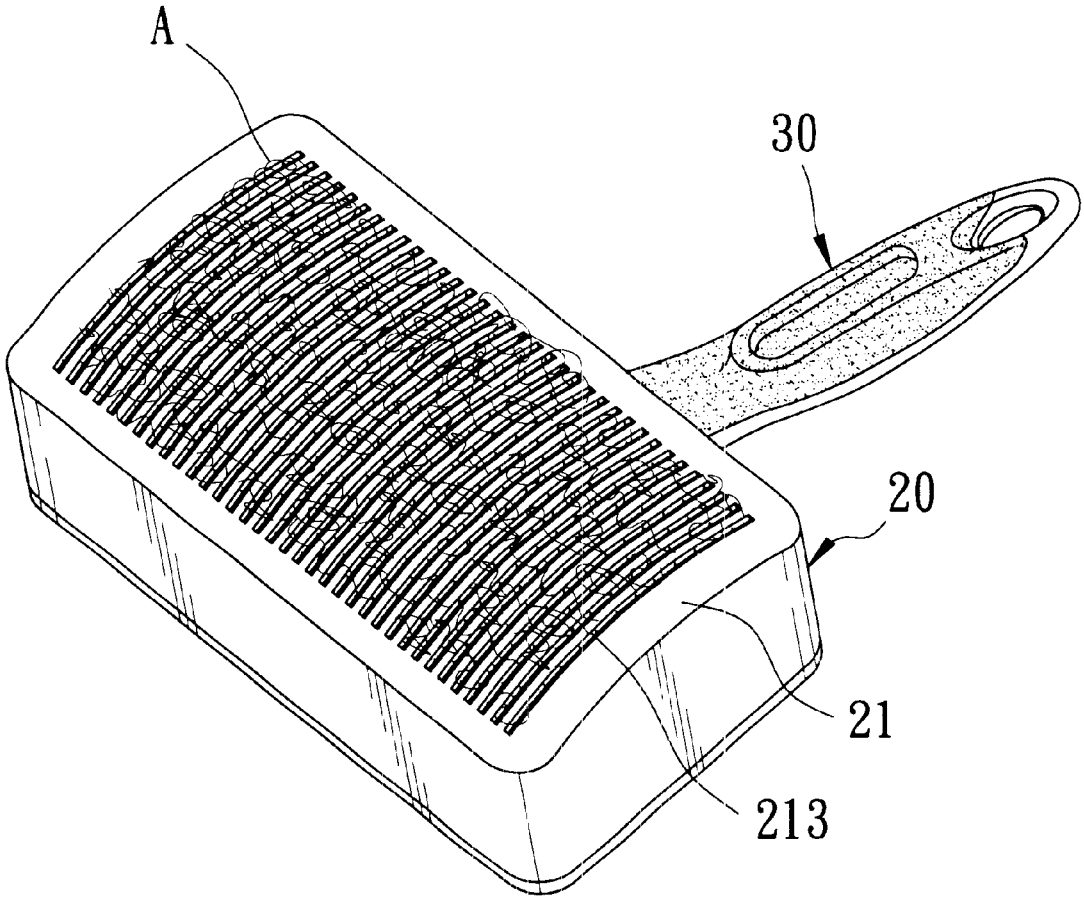
FIG. 5 is a perspective view of the preferred embodiment, illustrating how the tangled hair strands remain on a combing wall of the brush body after retraction of the bristles.

The handgrip 30 has an enlarged hollow head portion 301 fixed to the grip-mounting wall 23 of the brush body 20 and defining an inner space 323 therein which is in spatial communication with the bristle-receiving chamber 20C via an opening 311 that is formed through the grip-mounting wall 23, and an elongated shank portion 302 extending from the head portion 301. A connecting link 56 is disposed in the bristle-receiving chamber 20C, and has a first end 561 fixed to the bristle-holding element 40, and a second end 562 that extends through the opening 311 and into the inner space 323 in the head portion 301 of the handgrip 30. An engaging tongue 54 is fixed to and projects laterally and outwardly from the second end 562 of the connecting link 56. The operating member 50' includes a lever 50 having a pivot end 501 extending into the inner space 323 and pivoted to the head portion 301 of the handgrip 30 via a pivot pin 505, an operating end 502 opposite to the pivot end 501 and extending outwardly from the inner space 323 via an opening 324 in the head portion 301, and an intermediate portion 503 that is disposed between the pivot end 501 and the operating end 502 within the inner space 323 and that is formed with an arcuate slot 533. The lever 50 is rotatable about the pivot pin 505 upon actuation. The engaging tongue 54 extends into and slidably contacts a periphery of the arcuate slot 533 so as to permit movement of the connecting link 56 together with the bristle-holding element 40 toward and away from the combing wall 21 of the brush body 20 upon turning of the lever 50 about the pivot pin 505. Under such conditions, when hair strands (A) entangled in the bristles 42 and hinder smooth combing operation, the bristles 42 can be retracted into the bristle-receiving chamber 20C by turning the lever 50 about the pivot pin 505, as best shown in FIG. 4. The hair strands (A) remain on the combing wall 21 of the brush body 20, and can be easily removed from the combing wall 21 of the brush body 20, as shown in FIG. 5.

Preferably, four guide posts 51 (only two are visible in FIGS. 3 and 4) are mounted in parallel within the bristle-receiving chamber 20C, and extend between the combing wall 21 and the grip-mounting wall 23 of the brush body 20. The bristle-holding element 40 is slidably mounted on the guide posts 51. The urging member 55', preferably includes four coil springs 55 sleeved respectively on the guide posts 51 and disposed between the bristle-mounting element 40 and the grip-mounting wall 23 for urging the bristle-holding element 40 toward the combing wall 21 of the brush body 20.

Figure 6:
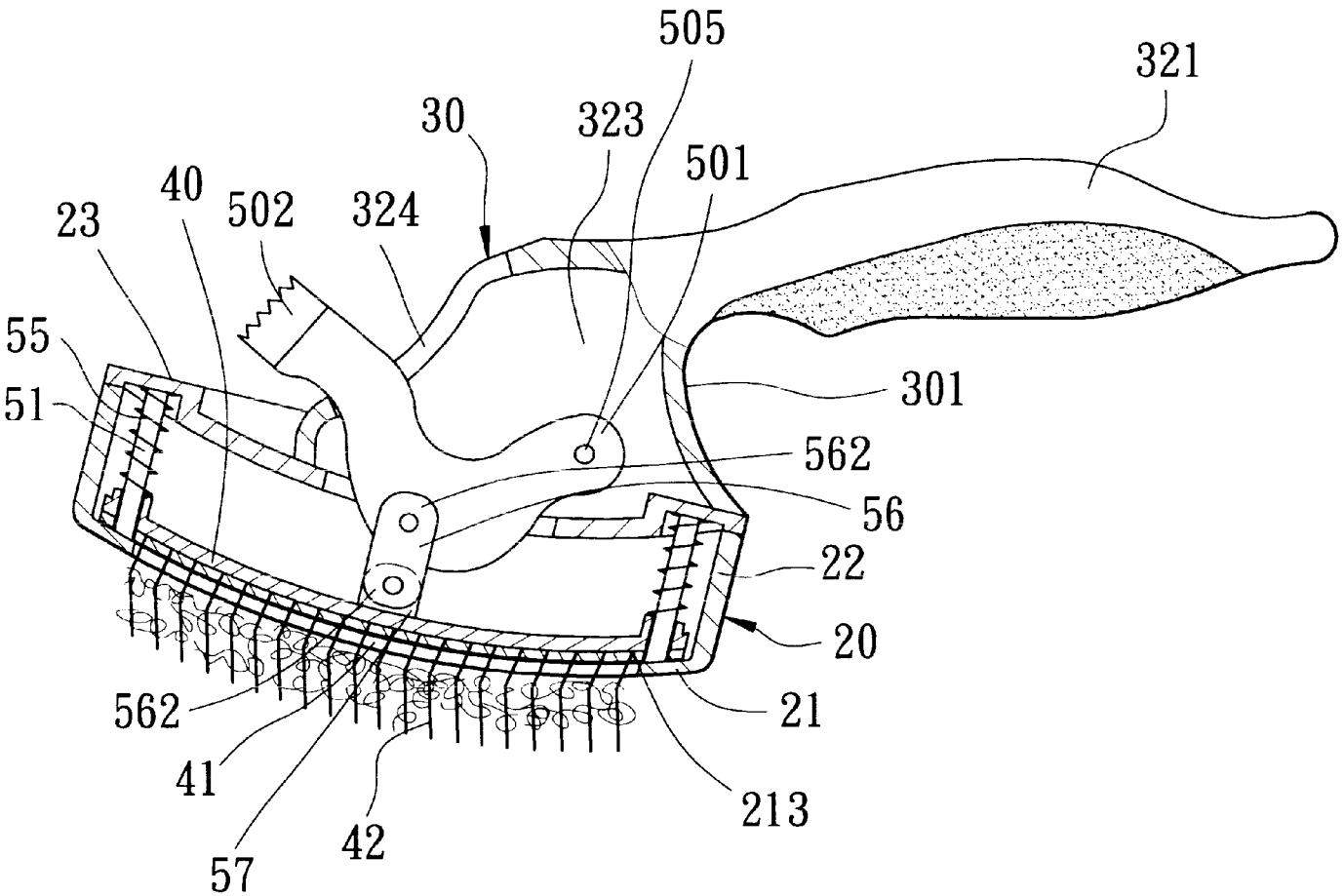
FIG. 6 is a fragmentary sectional view showing another preferred embodiment.
Figure 7:
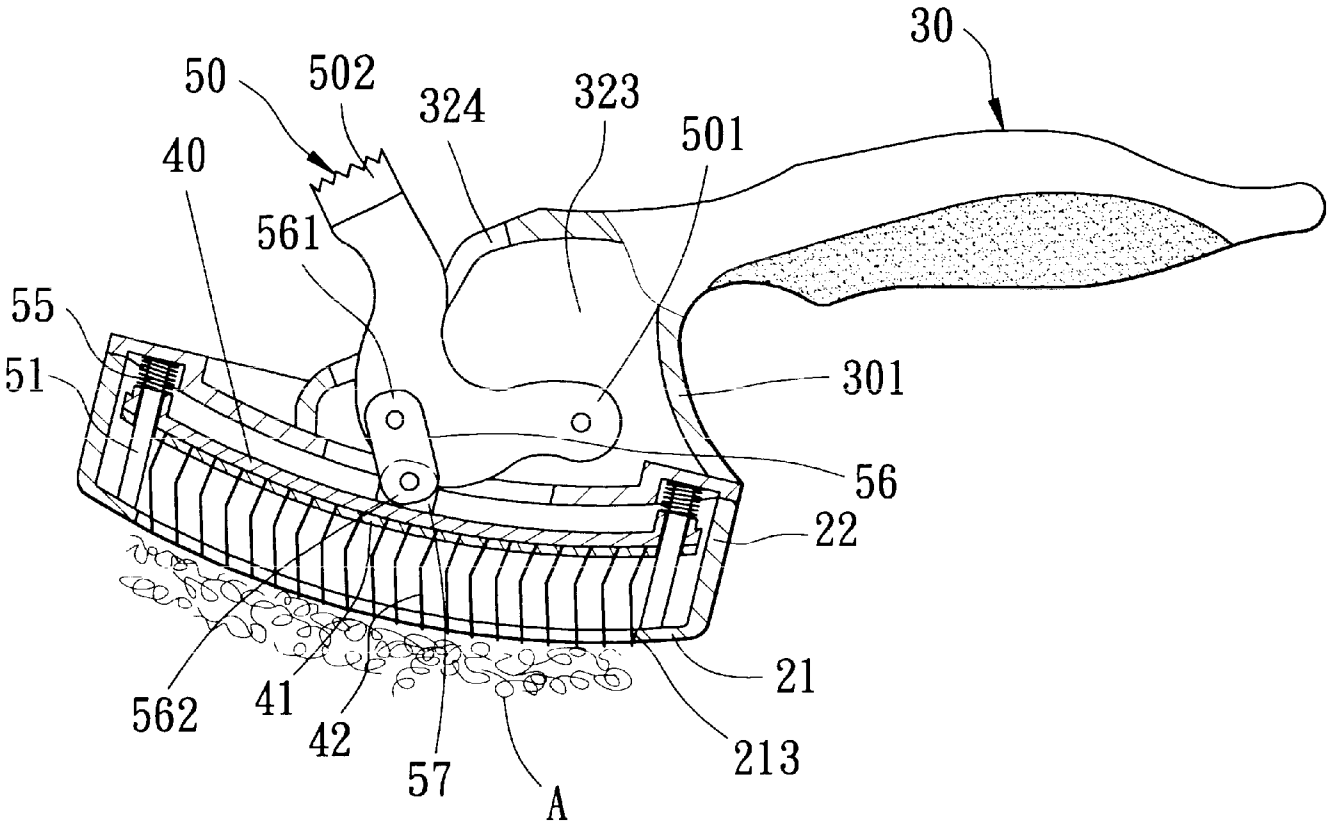
FIG. 7 is a fragmentary sectional view of the brush of FIG. 6, illustrating how the bristles are retracted into a bristle-receiving chamber by turning of an operating member in order to remove tangled hair strands therefrom.

Referring to FIGS. 6 and 7, another preferred embodiment of the present invention is shown to have a structure similar to that of the previous embodiment. The main difference resides in that a connecting stud 57 is disposed in the bristle-receiving chamber 20C, and is fixed to the bristle-holding element 40. A connecting link 56 is disposed in the bristle-receiving chamber 20C, and has a first end 561 pivoted to the connecting stud 57 and a second end 562 pivoted to the lever 50 at a position between the pivot and operating ends 501, 502 so as to permit movement of the connecting stud 57 together with the bristle-holding element 40 toward and away from the combing wall 21 of the brush body 20 upon turning of the lever 50 about the pivot pin 505.

With this invention thus explained, it is apparent that numerous modifications and variations can be made without departing from the scope and spirit of this invention. It is therefore intended that this invention be limited only as indicated by the appended claims.

I claim:

1. A brush comprising:

a brush body defining a bristle-receiving chamber therein, and having a combing wall formed with a plurality of bristle-extension apertures in spatial communication with said bristle-receiving chamber;

a bristle-holding element disposed movably in said bristle-receiving chamber and operable to move toward and away from said combing wall of said brush body;

a plurality of bristles mounted on said bristle-holding element and extending through said bristle-extension apertures in said combing wall, respectively;

an urging member disposed in said bristle-receiving chamber for urging said bristle-holding element toward said combing wall of said brush body;

an operating member connected to said bristle-holding element for moving said bristle-holding element against urging action of said urging member away from said combing wall of said brush body; and said brush body having a grip-mounting wall that is located opposite to said combing wall and that defines one side of said bristle-receiving chamber, said brush further comprising a handgrip that has an enlarged head portion fixed to said grip-mounting wall of said brush body, a connecting link disposed in said bristle-receiving chamber and having a first end fixed to said bristle-holding element and a second end extending toward said head portion of said handgrip, and an engaging tongue projecting from said second end of said connecting link, said operating member including a pivot pin, a lever having a pivot end pivoted to said head portion of said handgrip via said pivot pin, an operating end opposite to said pivot end, and an arcuate slot formed between said pivot end and said operating end, said lever being rotatable about said pivot pin, said engaging tongue extending into and slidably contacting a periphery of said arcuate slot so as to permit movement of said connecting link together with said bristle-holding element toward and away from said combing wall of said brush body upon turning of said lever about said pivot pin.

2. A brush comprising:

a brush body defining a bristle-receiving chamber therein, and having a combing wall formed with a plurality of bristle-extension apertures in spatial communication with said bristle-receiving chamber;

a bristle-holding element disposed movably in said bristle-receiving chamber and operable to move toward and away from said combing wall of said brush body;

a plurality of bristles mounted on said bristle-holding element and extending through said bristle-extension apertures in said combing wall, respectively;

an urging member disposed in said bristle-receiving chamber for urging said bristle-holding element toward said combing wall of said brush body;

an operating member connected to said bristle-holding element for moving said bristle-holding element against urging action of said urging member away from said combing wall of said brush body; and said brush body having a grip-mounting wall that is located opposite to said combing wall and that defines one side of said bristle-receiving chamber, said brush further comprising a handgrip that has an enlarged head portion fixed to said grip-mounting wall of said brush body, a connecting stud that is disposed in said bristle-receiving chamber and that is fixed to said bristle-holding element, and a connecting link disposed in said bristle-receiving chamber, said operating member including a pivot pin, a lever having a pivot end pivoted to said head portion of said handgrip via said pivot pin, and an operating end opposite to said pivot end, said lever being rotatable about said pivot pin, said connecting link having a first end pivoted to said connecting stud and a second end pivoted to said lever at a position between said pivot and operating ends so as to permit movement of said connecting stud together with said bristle-holding element toward and away from said combing wall of said brush body upon turning of said lever about said pivot pin.

3. A brush comprising:

a brush body defining a bristle-receiving chamber therein, and having a combing wall formed with a plurality of bristle-extension apertures in spatial communication with said bristle-receiving chamber;

a bristle-holding element disposed movably in said bristle-receiving chamber and operable to move toward and away from said combing wall of said brush body;

a plurality of bristles mounted on said bristle-holding element and extending through said bristle-extension apertures in said combing wall, respectively;

wherein said combing wall of said brush body has two opposing edges, said bristle-extension apertures being in the form of parallel elongated slots that extend between said opposing edges of said combing wall;

further comprising an urging member disposed in said bristle-receiving chamber for urging said bristle-holding element toward said combing wall of said brush body;

further comprising an operating member connected to said bristle-holding element for moving said bristle-holding element against urging action of said urging member away from said combing wall of said brush body; and said brush body having a grip-mounting wall that is located opposite to said combing wall and that defines one side of said bristle-receiving chamber, said brush further comprising a handgrip that has an enlarged head portion fixed to said grip-mounting wall of said brush body, a connecting link disposed in said bristle-receiving chamber and having a first end fixed to said bristle-holding element and a second end extending toward said head portion of said handgrip, and an engaging tongue projecting from said second end of said connecting link, said operating member including a pivot pin, a lever having a pivot end pivoted to said head portion of said handgrip via said pivot pin, an operating end opposite to said pivot end, and an arcuate slot formed between said pivot end and said operating end, said lever being rotatable about said pivot pin, said engaging tongue extending into and slidably contacting a periphery of said arcuate slot so as to permit movement of said connecting link together with said bristle-holding element toward and away from said combing wall of said brush body upon turning of said lever about said pivot pin.

4. A brush comprising:

a brush body defining a bristle-receiving chamber therein, and having a combing wall formed with a plurality of bristle-extension apertures in spatial communication with said bristle-receiving chamber;

a bristle-holding element disposed movably in said bristle-receiving chamber and operable to move toward and away from said combing wall of said brush body;

a plurality of bristles mounted on said bristle-holding element and extending through said bristle-extension apertures in said combing wall, respectively;

wherein said combing wall of said brush body has two opposing edges, said bristle-extension apertures being in the form of parallel elongated slots that extend between said opposing edges of said combing wall;

further comprising an urging member disposed in said bristle-receiving chamber for urging said bristle-holding element toward said combing wall of said brush body;

further comprising an operating member connected to said bristle-holding element for moving said bristle-holding element against urging action of said urging member away from said combing wall of said brush body; and said brush body having a grip-mounting wall that is located opposite to said combing wall and that defines one side of said bristle-receiving chamber, said brush further comprising a handgrip that has an enlarged head portion fixed to said grip-mounting wall of said brush body, a connecting stud that is disposed in said bristle-receiving chamber and that is fixed to said bristle-holding element, and a connecting link disposed in said bristle-receiving chamber, said operating member including a pivot pin, a lever having a pivot end pivoted to said head portion of said handgrip via said pivot pin, and an operating end opposite to said pivot end, said lever being rotatable about said pivot pin, said connecting link having a first end pivoted to said connecting stud and a second end pivoted to said lever at a position between said pivot and operating ends so as to permit movement of said connecting stud together with said bristle-holding element toward and away from said combing wall of said brush body upon turning of said lever about said pivot pin.

* * * * *